US011590557B2

(12) United States Patent
Kanazawa et al.

(10) Patent No.: US 11,590,557 B2
(45) Date of Patent: Feb. 28, 2023

(54) WIRE FORMING APPARATUS

(71) Applicant: KABUSHIKI KAISHA ITAYA SEISAKU SHO, Matsudo (JP)

(72) Inventors: Kenji Kanazawa, Matsudo (JP); Takashi Ando, Matsudo (JP)

(73) Assignee: KABUSHIKI KAISHA ITAYA SEISAKU SHO, Matsudo (JP)

( * ) Notice: Subject to any disclaimer, the term of this patent is extended or adjusted under 35 U.S.C. 154(b) by 61 days.

(21) Appl. No.: 17/207,183

(22) Filed: Mar. 19, 2021

(65) Prior Publication Data

US 2021/0308738 A1 Oct. 7, 2021

(30) Foreign Application Priority Data

Apr. 6, 2020 (JP) ..... JP2020-068621

(51) Int. Cl.

| | |
|---|---|
| ***B21F 3/12*** | (2006.01) |
| ***B21F 35/00*** | (2006.01) |
| ***B21F 3/02*** | (2006.01) |
| ***B21F 23/00*** | (2006.01) |
| ***B21F 27/04*** | (2006.01) |

(52) U.S. Cl.

CPC ..... *B21F 3/02* (2013.01); *B21F 3/12* (2013.01); *B21F 23/00* (2013.01); *B21F 27/04* (2013.01); *B21F 35/00* (2013.01)

(58) Field of Classification Search

CPC .... B21F 3/02; B21F 3/12; B21F 35/00; B21F 1/006; B21F 23/00; B21F 27/04

See application file for complete search history.

(56) References Cited

U.S. PATENT DOCUMENTS

| | | | | |
|---|---|---|---|---|
| 6,910,360 | B2 * | 6/2005 | Stjepan | B21F 35/00 226/110 |
| 7,143,620 | B2 | 12/2006 | Itaya | |
| 7,240,528 | B2 * | 7/2007 | Weise | B21F 1/00 72/31.11 |
| 7,610,787 | B2 | 11/2009 | Itaya | |

(Continued)

FOREIGN PATENT DOCUMENTS

| | | | |
|---|---|---|---|
| JP | 2004-122195 | A | 4/2004 |
| JP | 2005-111545 | A | 4/2005 |

(Continued)

OTHER PUBLICATIONS

Office Action for Japanese Patent Application No. 2020-068621 (dated May 14, 2021).

*Primary Examiner* — Lawrence Averick

(74) *Attorney, Agent, or Firm* — Merchant & Gould P.C.

(57) ABSTRACT

A wire forming apparatus 1 comprises a rotary table 22 that is rotatably supported by a table body 21, a slide tool unit 100A that is attached to the rotary table 22 and supports a slide tool T1 capable of sliding toward a wire guide, and a tool slide mechanism 60 that is supported by the table body 21 and transmits a driving force for sliding the slide tool T1 to the slide tool unit 100A. The tool slide mechanism 60 has a single motive power transmission member 61 that is rotatably supported by the table body 21, and a driving force generated by a rotation of the motive power transmission member 61 is transmitted, in common, to a plurality of slide tools T1 attached to the rotary table 22.

12 Claims, 13 Drawing Sheets

(56) References Cited

U.S. PATENT DOCUMENTS

| | | | | |
|---|---|---|---|---|
| 7,661,281 | B2 * | 2/2010 | Rubbert | B21F 45/008 72/306 |
| RE42,815 | E * | 10/2011 | Rubbert | A61C 7/20 29/407.04 |
| RE44,668 | E * | 12/2013 | Rubbert | B33Y 50/00 703/2 |
| 8,770,002 | B2 | 7/2014 | Takahashi | |
| 9,718,114 | B2 * | 8/2017 | Itaya | B21F 35/00 |
| 2003/0074944 | A1 * | 4/2003 | Stjepan | B21F 35/00 72/140 |
| 2006/0107720 | A1 * | 5/2006 | Rubbert | A61C 7/02 72/307 |
| 2007/0218419 | A1 * | 9/2007 | Rubbert | A61C 7/04 433/24 |
| 2015/0075244 | A1 * | 3/2015 | Itaya | B21F 3/12 72/135 |

FOREIGN PATENT DOCUMENTS

| | | | |
|---|---|---|---|
| JP | 2008-030058 | A | 2/2008 |
| JP | 5148759 | B2 | 2/2013 |
| JP | 5798162 | B2 | 10/2015 |

* cited by examiner

WIRE FORMING APPARATUS

CROSS-REFERENCE TO RELATED APPLICATION(S)

This application claims priority to and the benefit of Japanese Patent Application No. 2020-068621 filed on Apr. 6, 2020, the entire disclosure of which is incorporated herein by reference.

BACKGROUND OF THE INVENTION

Field of the Invention

The present invention relates to a wire forming apparatus for processing a wire into a desired shape.

Description of the Related Art

In a conventional wire forming apparatus, in order to process a wire into a final product shape, a process of rotating (twisting) a fed wire around a wire axis is necessary in some cases, in addition to a process of bending, curving, or winding the wire. In the conventional wire forming apparatus, the process of rotating a wire is performed by feed rollers for feeding the wire onto a forming table. That is to say, the wire is rotated by pivoting a pair of feed rollers around the wire axis while holding the wire from opposite sides with pressure using the feed rollers.

However, in the process of rotating the wire, since the wire has a curving tendency with a large curvature that causes the wire to bend in a winding direction, the direction of the curving tendency changes up and down and left and right every time the wire is rotated, affecting the process in that the final product shape varies, for example. Although the wire is held from opposite sides with pressure by the pair of feed rollers during the process of rotating the wire, repeated rotation of the wire over a long period of time causes slight slippage between the feed rollers and the wire, which, as it accumulates, leads to instability in the product shape. Furthermore, the wire being twisted between a wire supply mechanism and the feed rollers due to the process of rotating the wire also affects the stability of the product shape. The effect of twisting can be reduced by setting a sufficient distance from the wire supply mechanism to the feed rollers, but this effect cannot be completely eliminated and becomes more significant as the wire diameter is smaller.

Japanese Patent Nos. 5148759 and 5798162 propose wire forming apparatuses in which the process of rotating a wire is not performed, and a tool can be rotated around the axis of the wire.

Japanese Patent No. 5148759 describes a configuration in which a plurality of tool slides are radially arranged on a rotary table, and driving mechanisms, the number of which corresponds to the number of tool slides, are radially arranged on a forming table around the rotary table. Japanese Patent No. 5798162 describes a configuration in which a rotary table is arranged on a table capable of moving in a two-dimensional direction and a plurality of tool slides are radially arranged on the rotary table such that a rotation tool (spinner) that rotates around a tool shaft can be set at any rotation angle by the rotary table and such that the rotation tool can be driven regardless of the angular position of the rotation tool.

In Japanese Patent No. 5148759, a plurality of tool slides are radially arranged on a rotary table, and driving mechanisms, the number of which corresponds to the number of tool slides, are radially arranged on a forming table around the rotary table.

However, to always enable the tool to be driven regardless of the rotational position of the rotary table, driving mechanisms, the number of which corresponds to the number of tool slides, need to be arranged on the forming table. Furthermore, in Japanese Patent No. 5148759, when rotating the rotary table with the tool slides attached, the driving mechanisms on the forming table need to be retracted rearward.

In Japanese Patent No. 5798162, the positions of the slide tools are changed and a sliding operation is performed by moving the two-dimensional table in an XY direction, but it is difficult to rapidly move the two-dimensional table, which is heavy, and there is a problem in productivity improvement.

SUMMARY OF THE INVENTION

The present invention has been made in consideration of the aforementioned problems, and realizes a wire forming apparatus that can rapidly drive tools arranged on a rotary table to slide or rotate, and rotate the table using a simple driving mechanism without performing an operation to rotate a wire around a wire axis, and that can also freely set the type and the number of tools arranged on the rotary table.

In order to solve the aforementioned problems, the present invention provides a wire forming apparatus that feeds a wire to a forming space at a leading end of a wire guide and processes the wire into a desired shape using a plurality of tools that are radially arranged, the apparatus comprising: a rotary table that is rotatably supported by a table body and can rotate to change relative positions of the tools with respect to the wire guide, the tools being able to be attached to and detached from the rotary table; a table driving mechanism that is supported by the table body and rotates the rotary table; a slide tool unit that is attached to the rotary table and supports a slide tool capable of sliding toward the wire guide, of the plurality of tools; and a tool slide mechanism that is supported by the table body and transmits a driving force for sliding the slide tool to the slide tool unit, wherein the tool slide mechanism has a single motive power transmission member that is rotatably supported by the table body, and a driving force generated by a rotation of the motive power transmission member is transmitted, in common, to a plurality of slide tools attached to the rotary table.

According to the present invention, a wire forming apparatus that can rapidly drive tools arranged on a rotary table to slide or rotate, and rotate the table using a simple driving mechanism without performing an operation to rotate a wire around a wire axis, and that can also freely set the type and the number of tools arranged on the rotary table, can be realized.

Further features of the present invention will become apparent from the following description of exemplary embodiments (with reference to the attached drawings.

DESCRIPTION OF THE EMBODIMENTS

Figure 1:
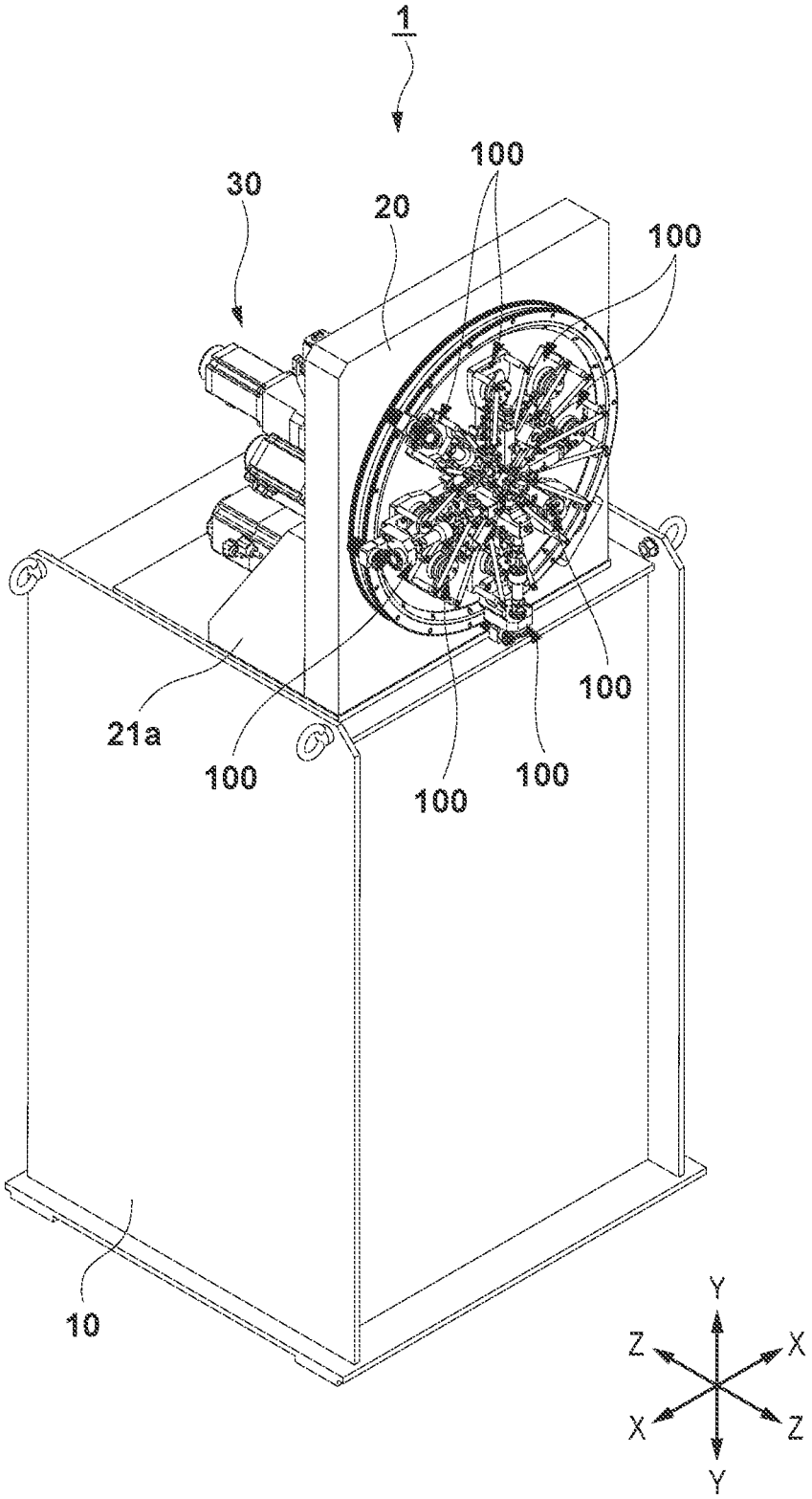
FIG. 1 is a front perspective view of a spring manufacturing apparatus of the present embodiment.

Hereinafter, embodiments will be described in detail with reference to the attached drawings. Note that the following embodiments are not intended to limit the scope of the claimed invention, and limitation is not made an invention that requires all combinations of features described in the embodiments. Two or more of the multiple features described in the embodiments may be combined as appropriate. Furthermore, the same reference numerals are given to the same or similar configurations, and redundant description thereof is omitted.

Although a description will be given below of an example of applying a wire forming apparatus of the present invention to a spring manufacturing apparatus for forming a wire into a spring with a desired shape, the wire forming apparatus of the present invention can also be applied to apparatuses for forming any parts other than a spring.

Apparatus Configuration

First, a configuration and functions of a spring manufacturing apparatus of the present embodiment will be described with reference to FIGS. 1 to 12.

Figure 2A:
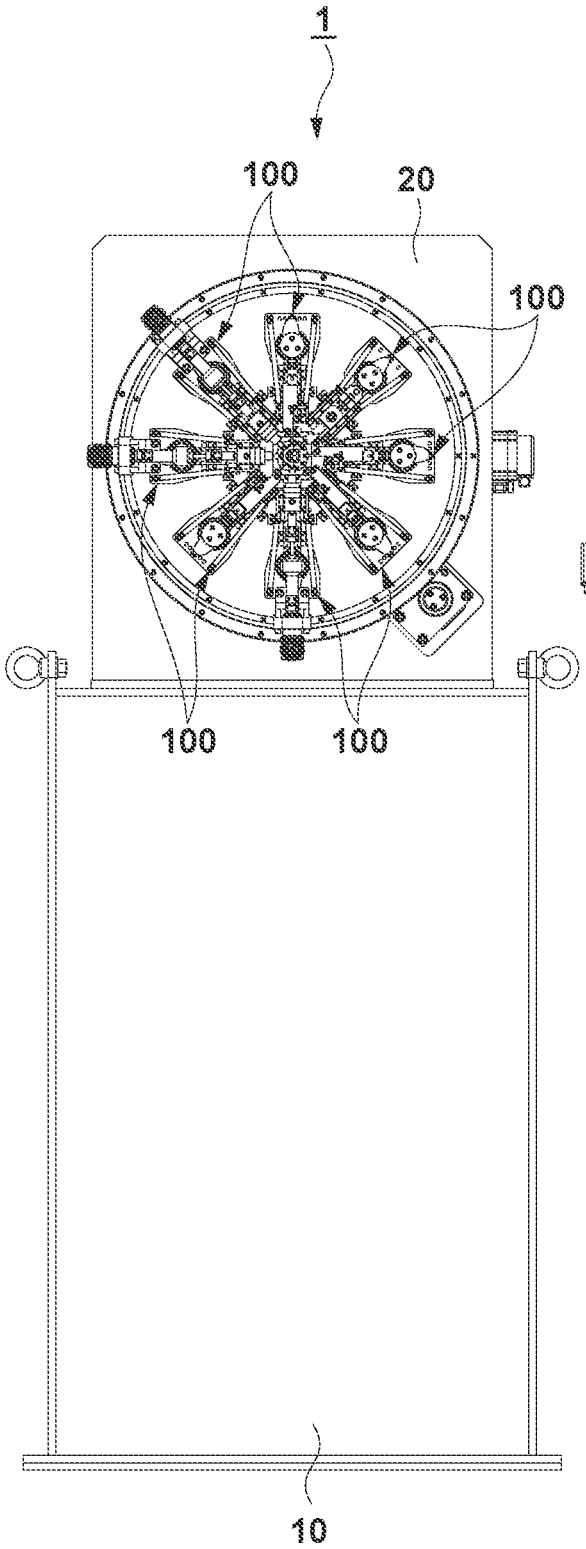
FIG. 2A is a front elevational view of the spring manufacturing apparatus of the present embodiment.
Figure 2B:
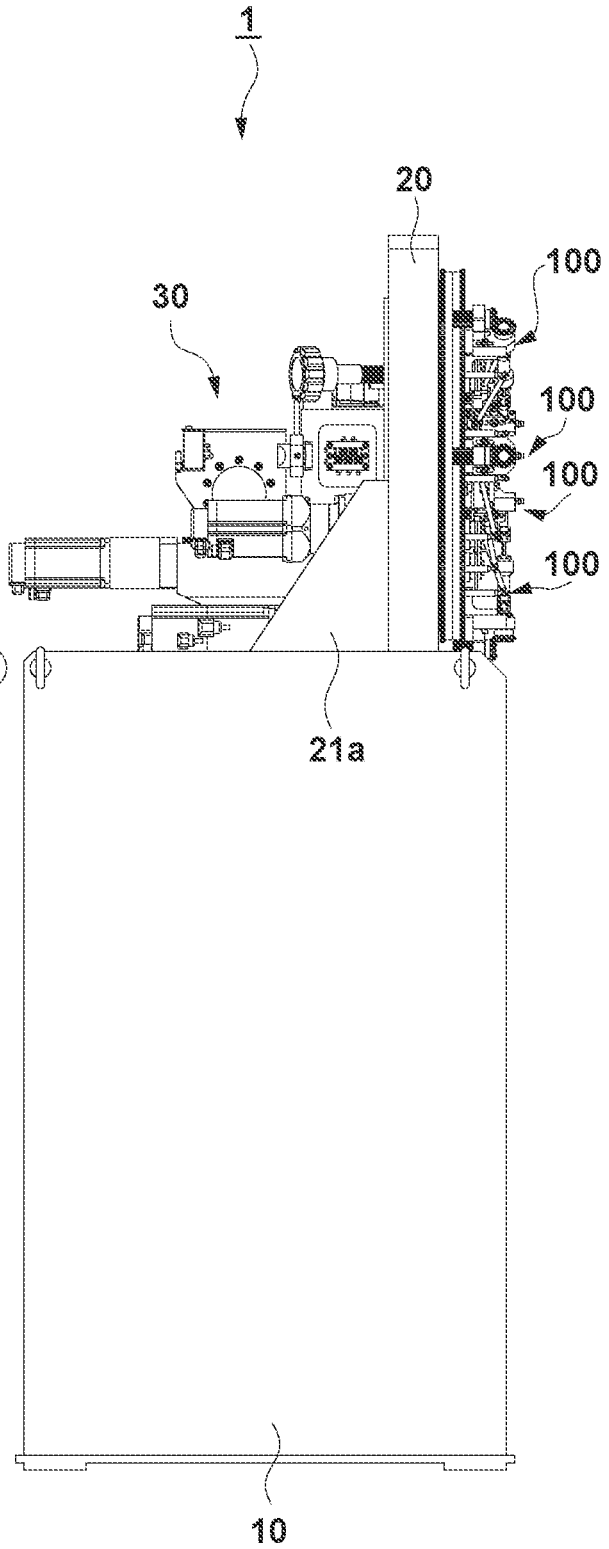
FIG. 2B is a left side view of the spring manufacturing apparatus of the present embodiment.
Figure 3:
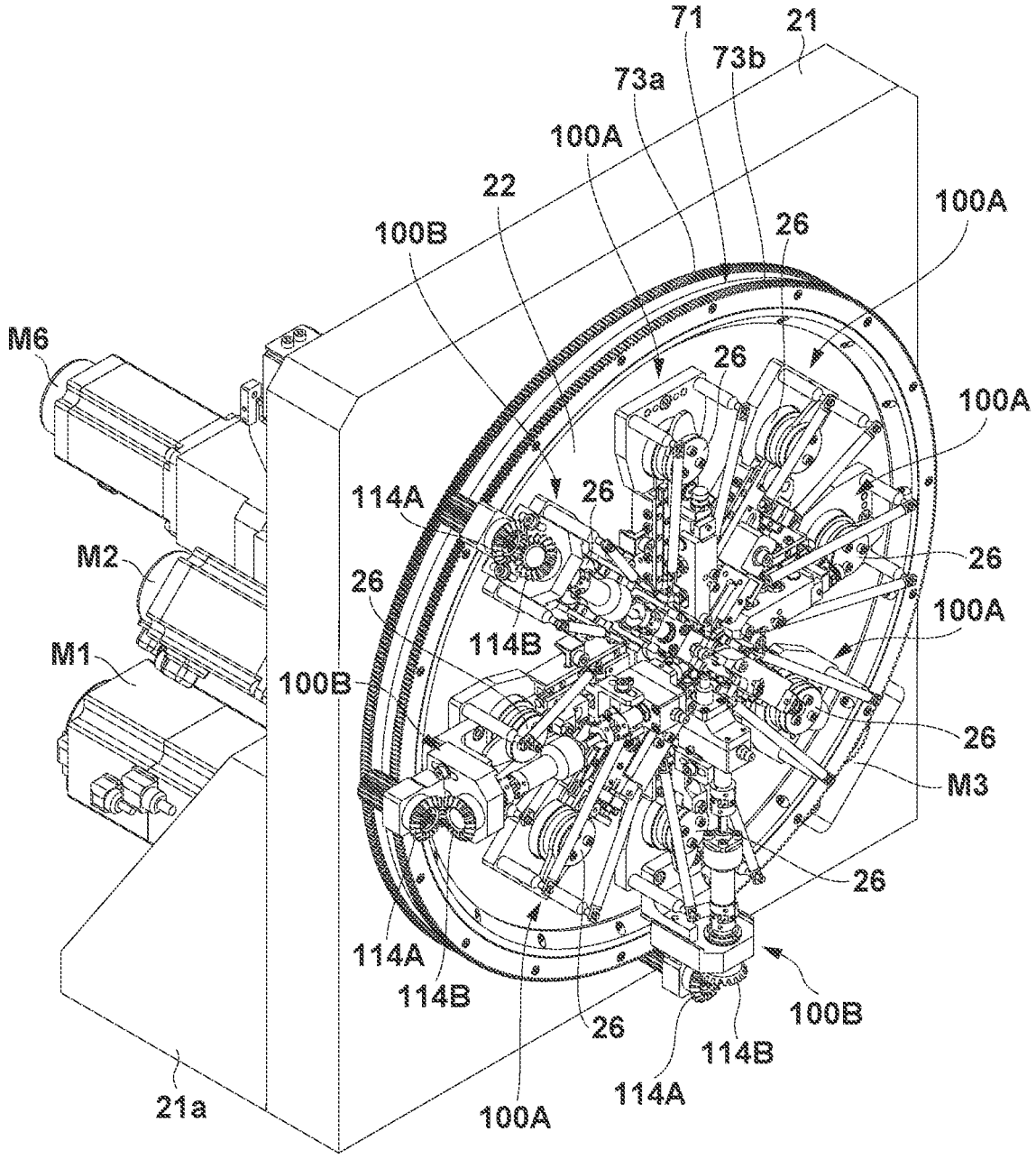
FIG. 3 is a front perspective view of a forming table in FIG. 1.

As shown in FIGS. 1, 2A, and 2B, a spring manufacturing apparatus 1 of the present embodiment includes a box-shaped base 10, a forming table 20 that is attached to an upper portion of the base 10, a wire feeder 30 that is arranged on a back face of the forming table 20, and tool units 100 that are attached to a front face portion of the forming table 20.

As shown in FIGS. 3 to 9, the forming table 20 includes a rectangular table body 21 that constitutes an outer frame, and a rotary table 22 that is arranged at a center portion of the table body 21. The table body 21 is firmly supported at an upper portion of the base 10 by reinforcing members 21*a* that are provided on the left and right sides (end portions in a Y direction). In the table body 21, a circular opening portion 23 is formed at the center portion, and an outer-circumferential groove portion 24 is formed radially outward of the opening portion 23 over the entire circumference. The rotary table 22 is a member that is rotatably provided in the outer-circumferential groove portion 24 of the table body 21 and has a hollow, disc-like outer shape with a center portion thereof open, and one or more tool units 100, which will be described later, can be attached to and removed from a front face portion of the rotary table 22.

The table body 21 is provided with a table driving mechanism 40 that drives the rotary table 22 to rotate, a tool slide mechanism 60 that drives slide tools T1 or rotation tools T2 of the tool units 100 attached to the rotary table 22 to slide, and a tool rotation mechanism 70 that drives the rotation tools T2 to rotate around respective tool shafts.

In the rotary table 22, a wire guide unit 90 is arranged in a hollow center opening portion 22*a* of the table, and a plurality of tool units 100 are radially arranged around a wire axis W of a wire guide 91. An outer gear 28 is formed on a back side of an outer-circumferential portion 22*b* of the rotary table 22 over the entire circumference.

The rotary table 22 is rotatably supported by the table body 21 via a bearing 27 that is provided in the outer-circumferential groove portion 24 of the table body 21. In the rotary table 22, a plurality of hole portion 25 are formed at positions at the same distance from the wire axis W of the wire guide unit 90. In the present embodiment, eight hole portions 25 are formed at equal intervals of 45 degrees. A cam mechanism 26 is arranged in each of the hole portions 25. That is to say, eight cam mechanisms 26 are arranged at equal intervals of 45 degrees in the front face portion of the rotary table 22, and are provided in correspondence with tool attachment positions on the rotary table 22. Each of the cam mechanisms 26 has a configuration in which an eccentric cam 26*a* is attached on a front side of a rotating shaft 26*b*, a gear 26*c* is formed on a back side, and the rotating shaft 26*b* is rotatably supported within a cylindrical case 26*e* by a bearing 26*d*. A ring gear 71 of the tool rotation mechanism 70 is rotatably supported via a bearing 72 on a front side of the outer-circumferential portion 22*b* of the rotary table 22. One or more tool units 100 (in this example, eight tool units 100A and 100B at equal intervals of 45 degrees) can be attached to and detached from the front face portion of the rotary table 22. Note that the number of tool units that can be arranged on the rotary table 22 is not limited to eight but can be changed. The rotary table 22 can be pivoted clockwise and counterclockwise at any angle by a driving force of a servo motor M1 of the table driving mechanism 40 that is provided in a back face portion of the table body 21. In the table driving mechanism 40, a drive gear (not shown) of the servo motor M1 meshes with the outer gear 28 of the rotary table 22 and is driven to rotate by the servo motor M1. The table driving mechanism 40 can pivot the rotary table 22 at a preset angle by transmitting the rotation of the servo motor M1 to the rotary table 22 via the outer gear 28 and so on, in accordance with a control command from a controller, which will be described later with reference to FIG. 13.

The tool slide mechanism 60 has a ring member 61 with a ring-like outer shape that has an inner gear 62 formed over the entire circumference of an inner-circumferential portion, and is rotatably supported via a bearing 63 that is provided in an inner-circumferential portion of the opening portion 23 of the table body 21. The ring member 61 can be rotated by a driving force of a servo motor M2 of the tool slide mechanism 60 that is provided in the back face portion of the table body 21. A drive gear 2 of the servo motor M2 meshes with the inner gear 62 of the ring member 61, and the ring member 61 is driven to rotate by the servo motor M2. The tool slide mechanism 60 can relatively rotate the ring member 61 at a predetermined speed, independently of the rotary table 22, by transmitting the rotation of the servo motor M2 to the ring member 61 via the inner gear 62 and so on, in accordance with a control command from the controller, which will be described later with reference to FIG. 13.

The tool rotation mechanism 70 has the ring gear 71 with a ring-like outer shape that has outer gears 73*a* and 73*b* formed in two rows over the entire circumference of an outer-circumferential portion, and is rotatably supported via the bearing 72 that is provided in the outer-circumferential portion of the rotary table 22. The ring gear 71 can be rotated by a driving force of a servo motor M3 of the tool rotation mechanism 70 that is provided in the back face portion of the table body 21. A drive gear 3 of the servo motor M3 meshes with an outer gear 73*a* on the back side of the ring gear 71, and the ring gear 71 is driven to rotate by the servo motor M3. The tool rotation mechanism 70 can relatively rotate the ring gear 71 at a predetermined speed, independently of the rotary table 22, by transmitting the rotation of the servo motor M3 to the ring gear 71 via the outer gear 73*a* and so on, in accordance with a control command from the controller, which will be described later with reference to FIG. 13.

The tool units 100 attached to the rotary table 22 includes slide tool units 100A that slide the slide tools T1 toward the wire axis W, and rotation tool units 100B that slide the rotation tools T2 toward the wire axis W and rotate the rotation tools T2 around respective tool shafts. Note that the slide tools T1 include a tool that forcibly bends a wire, a tool that comes into contact with a wire and forcibly curves and winds the wire, and a tool that cuts a wire. The rotation tools T2 includes a tool that forcibly bends and winds a wire.

A slide tool T1 is slidably attached to each slide tool unit 100A. Each slide tool unit 100A includes a slider 102 for holding and sliding the slide tool unit T1, and slides the tool T1 due to the slider 102 coming into contact with the eccentric cam 26*a* of the corresponding cam mechanism 26. The gear 26*c* of the cam mechanism 26 that is provided on a back side of the rotating shaft 26*b* of the eccentric cam 26*a* meshes with the inner gear 62 of the ring member 61 of the tool slide mechanism 60, and the eccentric cam 26*a* rotates.

A rotation tool T2 is rotatably attached to each rotation tool unit 100B. The tool T2 is called a spinner. Each rotation tool unit 100B includes a shaft unit 112 for holding and rotating the rotation tool T2, and a slider 111 that slidably holds the shaft unit 112, and drives the tool T2 to rotate around the tool shaft due to the slider 111 coming into contact with the eccentric cam 26*a* of the cam mechanism 26 to slide the shaft unit 112 that holds the tool T2, and the shaft unit 112 being driven to rotate via a bevel gear pair 114*a*, 114*b* that mesh with the ring gear 71 of the tool rotation mechanism 70.

While a spring is formed, the positions of the slide tools T1 and the rotation tool T2 with respect to the wire guide 91 are set by the rotational direction and the rotation angle of the rotary table 22. The slide operation of the slide tools T1 and the rotation tools T2 that approach the wire guide 91 or retract therefrom is set by a cam profile and the rotation angle of the eccentric cam 26*a* of the cam mechanism 26. The rotation operation of the rotation tools T2 is set by the rotation angle of the ring gear 71 of the tool rotation mechanism 70.

Configuration for Driving Slide Tools

Figure 8:
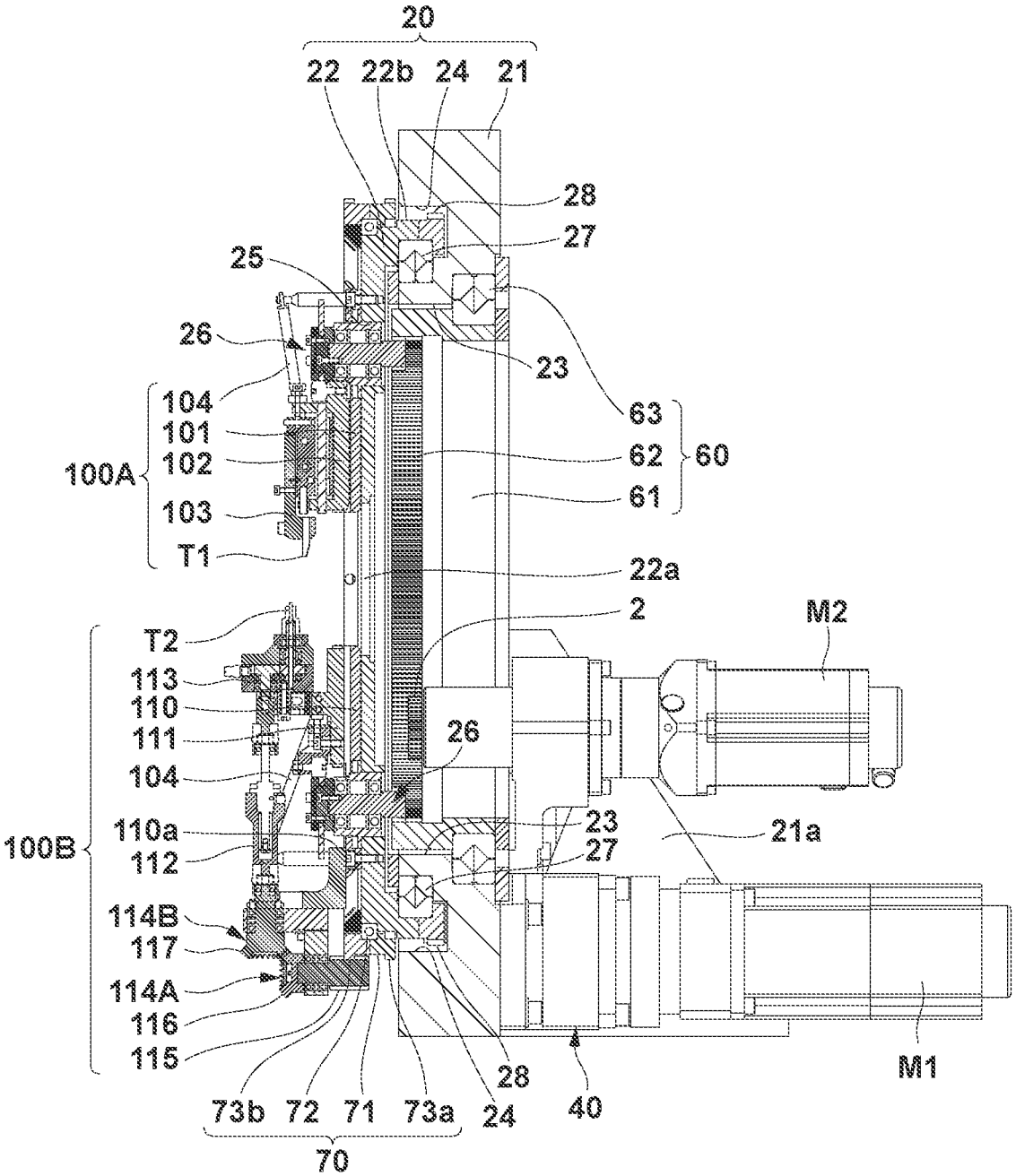
FIG. 8 is a cross-sectional view of FIG. 4 taken along I-I, showing the forming table from which a wire feeder and a wire guide unit are removed.
Figure 9:
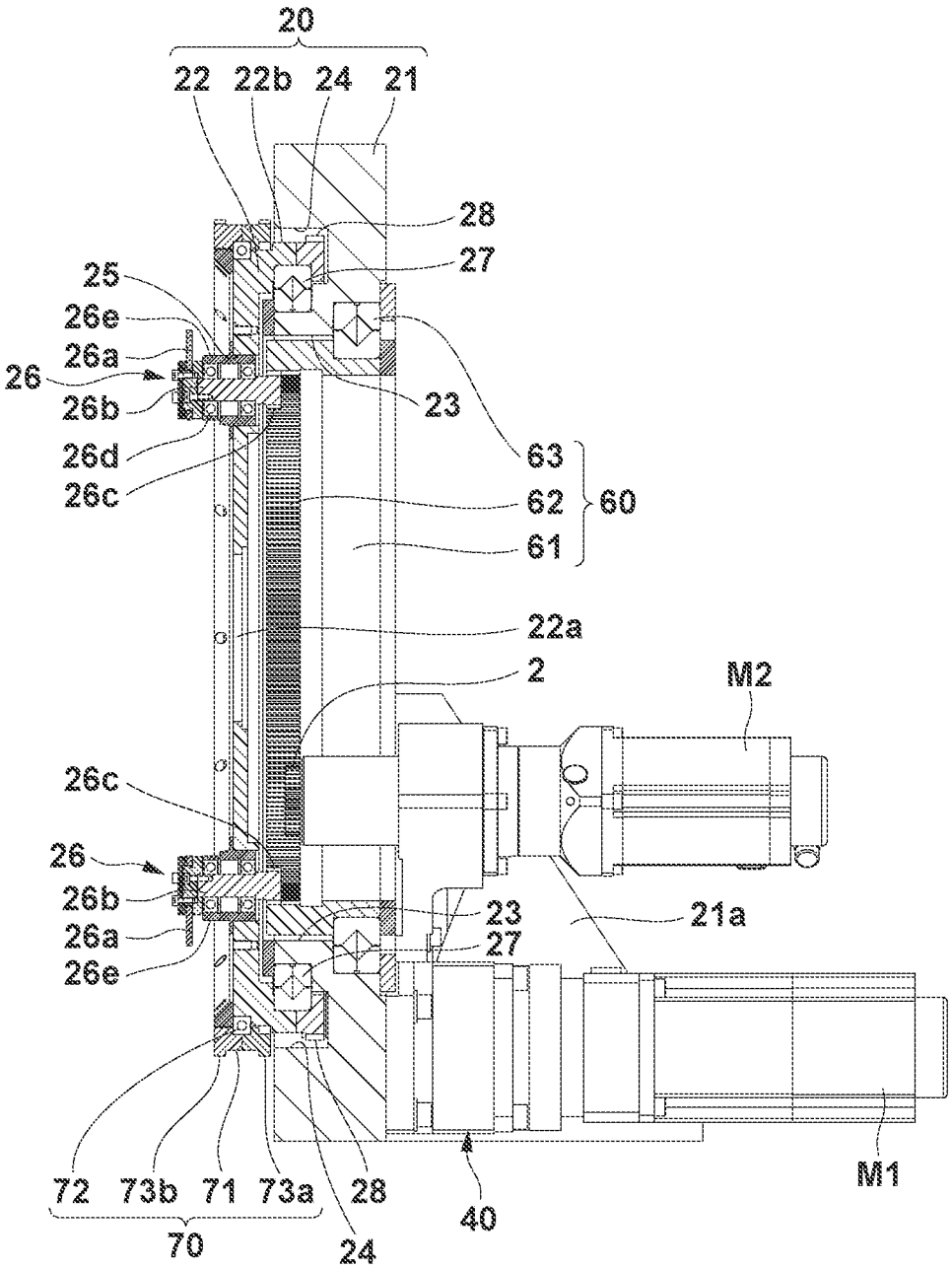
FIG. 9 is a cross-sectional view of FIG. 7 taken along II-II, showing the forming table from which the wire feeder and the wire guide unit are removed.

Next, a configuration for driving the slide tools T1 will be described with reference to FIGS. 8 and 9.

Each slide tool unit 100A has a base member 101 that is attached to the rotary table 22, the slider 102 that is slidably supported by the base member 101, and a tool holding member 103 that is attached to the slider 102.

Two compression springs 104, which are fixed to the base member 101, are attached to an end portion of the slider 102 on the side opposite to the wire guide 91, and the slider 102 is constantly biased toward the side opposite to the wire guide 91 by these compression springs 104. With the slide tool unit 100A being attached to the rotary table 22, the end portion of the slide 102 on the side opposite to the wire guide 91 is constantly in contact with the eccentric cam 26*a* of the cam mechanism 26, and the slider 102 slides toward the wire guide 91 against the biasing force of the compression springs 104 due to the eccentric cam 26*a* being rotated by the ring member 61 of the tool slide mechanism 60. The gear 26*c* of the cam mechanism 26 that is provided on the back side of the rotating shaft 26*b* of the eccentric cam 26*a* meshes with the inner gear 62 of the ring member 61 of the tool slide mechanism 60 to rotate the eccentric cam 26*a*, and the tool T1 is slid in accordance with the cam profile due to the rotating eccentric cam 26*a* coming into contact with the slider 101.

Due to the gear 26*c* formed on the rotating shaft 26*b* of the cam mechanism 26 constantly meshing with the inner gear 62 of the ring member 61 of the tool slide mechanism 60 that relatively rotates independently of the rotary table 22, the rotation tool T1 can be driven to slide in a state where the slide tool unit 100A is rotationally moved to any position by the rotary table 22.

With this configuration, the driving force generated by the rotation of the ring member 61 is transmitted by rotating a single ring member 61 serving as a driving force transmission member, in common, to the plurality of slide tools T1 attached to the rotary table 22, and the slide tools T1 of all slide tool units 100A attached to the rotary table 22 can be driven.

Configuration for Driving Rotation Tools

Next, a configuration for driving the rotation tools T2 will be described with reference to FIGS. 8 and 9.

Each rotation tool unit 100B has a base member 110 that is attached to the rotary table 22, a slider 111 that is slidably supported by the base member 110, a shaft unit 112 that is rotatably supported by the slider 111, and a tool holding member 113 that is connected to the shaft unit 112.

Two compression springs 104, which are fixed to the base member 110, are attached to an end portion of the slider 111 on the side opposite to the wire guide 91, and the slider 111 is constantly biased toward the side opposite to the wire guide 91 by these compression springs 104. With the rotation tool unit 100B being attached to the rotary table 22, the end portion of the slider 111 on the side opposite to the wire guide 91 is constantly in contact with the eccentric cam 26*a* of the cam mechanism 26, and the slider 111 slides toward the wire guide 91 against the biasing force of the compression springs 104 due to the eccentric cam 26*a* being rotated by the ring member 61 of the tool slide mechanism 60. The gear 26*c* of the cam mechanism 26 that is provided on the back side of the rotating shaft 26*b* of the eccentric cam 26*a* meshes with the inner gear 62 of the ring member 61 of the tool slide mechanism 60 to rotate the eccentric cam 26*a*, and the tool T2 is slid in accordance with the cam profile due to the rotating eccentric cam 26*a* coming into contact with the slider 101.

The base member 110 rotatably supports the bevel gear pair 114. The bevel gear pair 114 includes a first gear portion 114A and a second gear portion 114B. The first gear portion 114A has, at one end portion, a first spur gear 115 that meshes with the outer gear 73*b* on a front side of the ring gear 71, and a first bevel gear 116 is attached to the other end portion. The second gear portion 114B has a second bevel gear 117 that is attached to an end portion of the shaft unit 112.

Due to the first bevel gear 116 of the first gear portion 114A meshing with the second bevel gear 117 of the second gear portion 114B, upon the ring gear 71 of the tool rotation mechanism 70 rotating, the direction of a rotating shaft of the first gear portion 114A is turned by 90 degrees to transmit a driving force to the second gear portion 114B, the shaft unit 112 is rotated by a rotational driving force of the second gear portion 114B, and the tool holding member 113 that holds the tool T2 connected to the shaft unit 112 rotates.

Due to the first gear portion 114A constantly meshing with one outer gear, namely the outer gear 73*b* on the front side of the ring gear 71 of the tool rotation mechanism 70 that relatively rotates independently of the rotary table 22, the rotation tool T2 can be driven around the tool shaft in a state where the rotation tool unit 100B is rotationally moved to any position by the rotary table 22.

Note that the base member 110 has an opening portion 110*a* for the eccentric cam 26*a* of the cam mechanism 26 to penetrate, and the rotation tool unit 100B can be attached to the rotary table 22 such that the cam mechanism 26 does not interfere with the rotation tool T2.

With this configuration, the driving force generated by the rotation of the ring member 61 is transmitted, in common, to the plurality of rotation tools T2 attached to the rotary table 22 by rotating a single ring member 61 serving as a driving force transmission member, and the rotation tools T2 of all rotation tool units 100B attached to the rotary table 22 can be driven.

Also, the driving force generated by the rotation of the ring gear 71 is transmitted, in common, to the plurality of rotation tools T2 attached to the rotary table 22 by rotating a single ring gear 71 serving as a driving force transmission member, and the rotation tools T2 of all rotation tool units 100B attached to the rotary table 22 can be driven.

Figure 4:
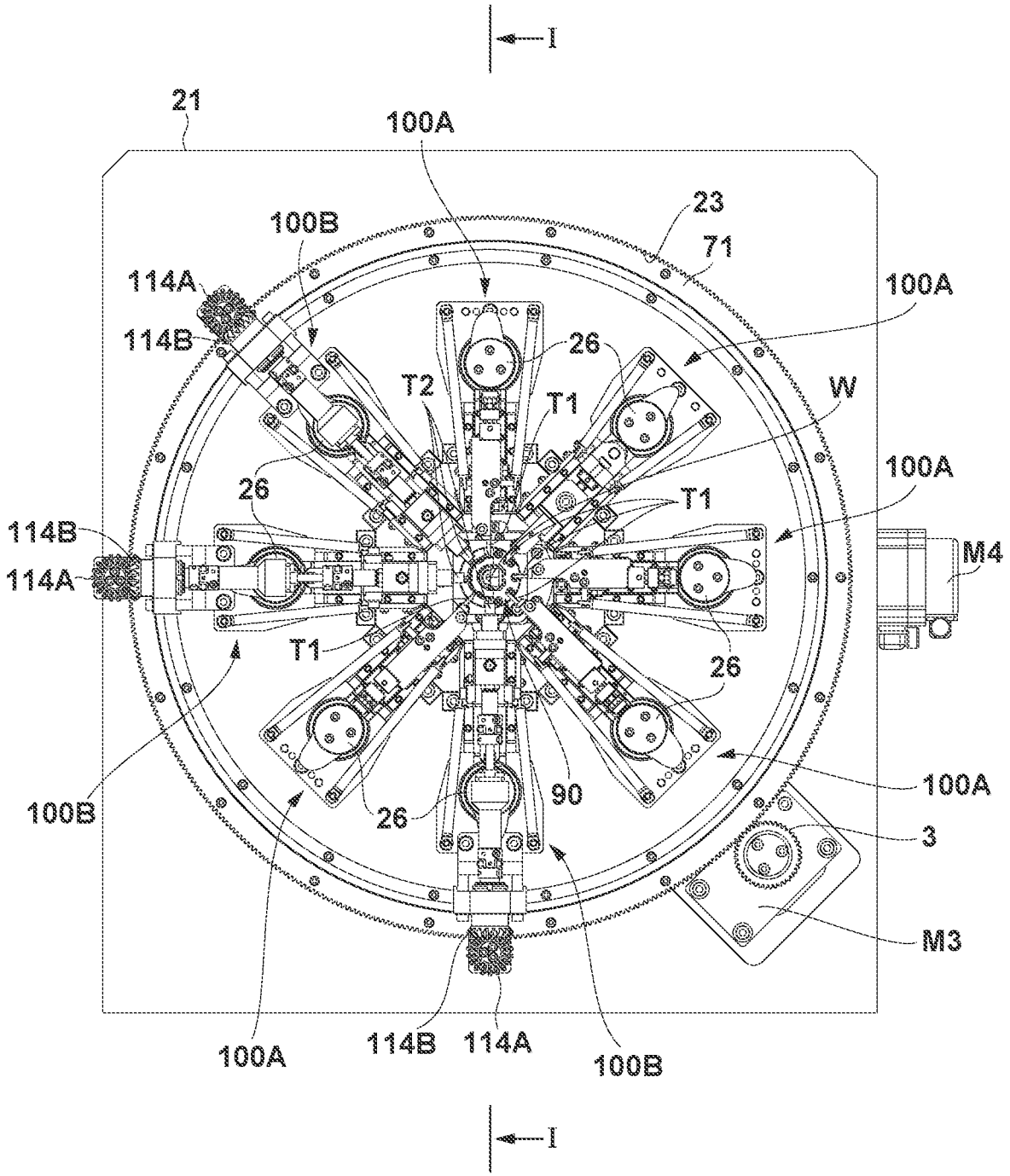
FIG. 4 is a front elevational view of the forming table in FIG. 1.
Figure 5:
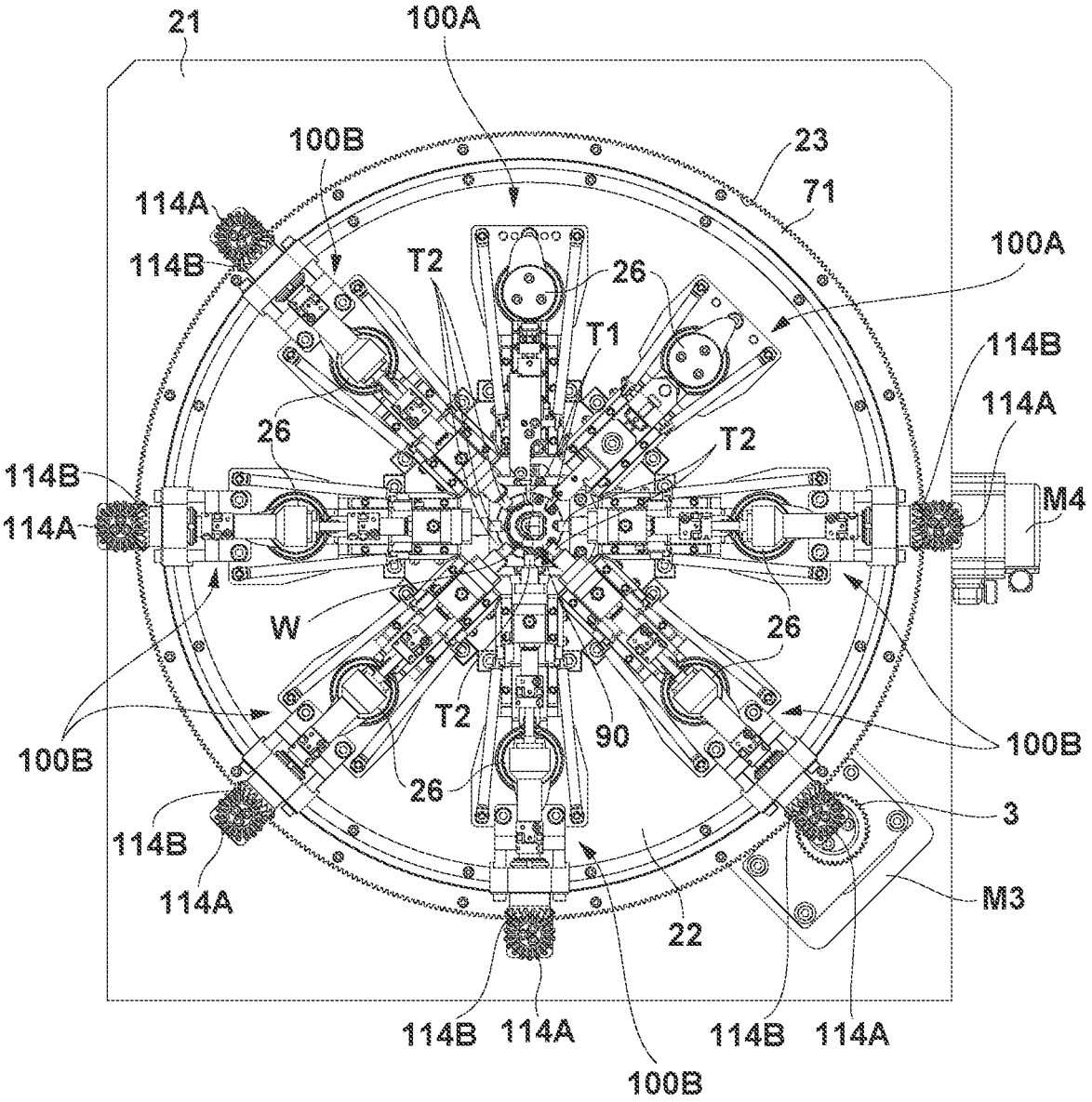
FIG. 5 is a front elevational view of the forming table with different tool arrangement from FIG. 1.
Figure 6:
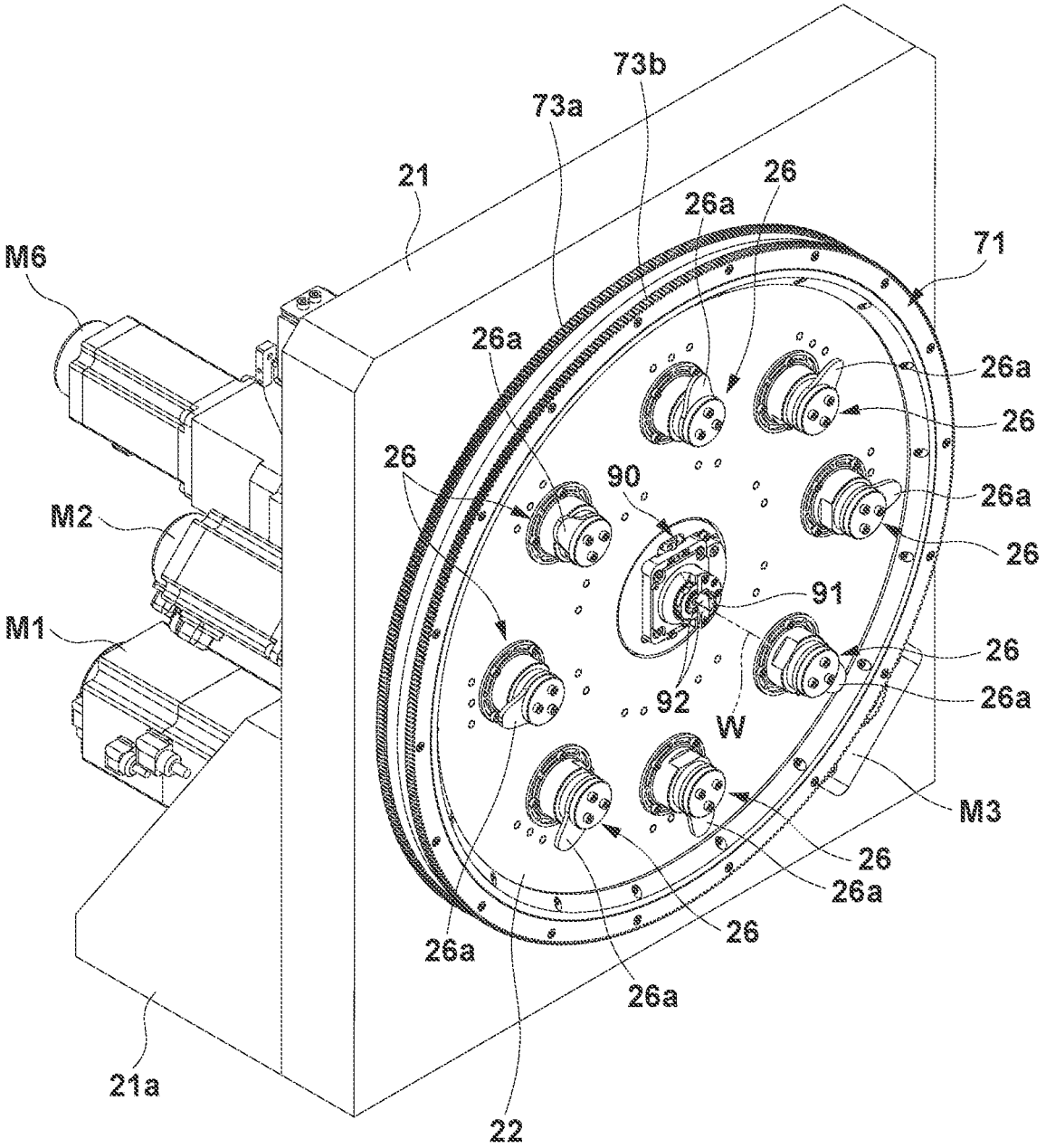
FIG. 6 is a front perspective view of the forming table in FIG. 3 from which tools are removed.
Figure 7:
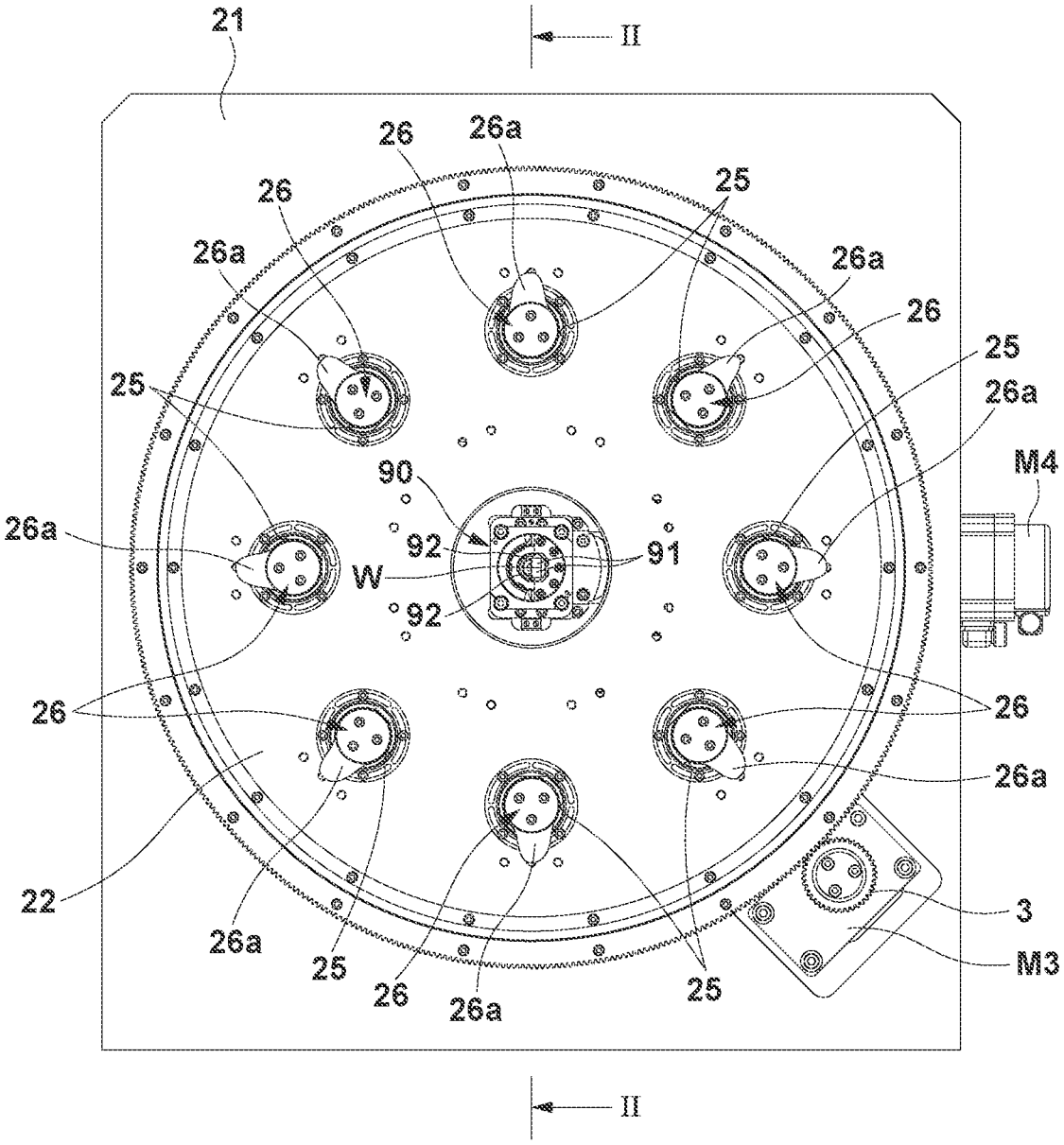
FIG. 7 is a front elevational view of the forming table in FIG. 3 from which the tools are removed.

According to the above-described configuration, the same number of driving sources for the slide tools T1 and the rotation tools T2 as the number of tool units does not need to be provided. In addition, the rotational positions of the tools are not limited by the position of the driving source, and it is possible to rapidly drive the tools T1 and T2 arranged on the rotary table 22 to slide, drive the tools T2 to rotate, and rotate the rotary table 22 using a simple driving mechanism, without performing a retraction operation or the like. Furthermore, as shown in FIGS. 4 and 5, it is also possible to freely set the type and the number of tools T1 and T2 arranged on the rotary table 22 in accordance with the shape of a spring to be formed. FIG. 4 shows an example of a state where five slide tool units 100A and three rotation tool units 100B are attached to the rotary table 22. FIG. 5 shows an example of a state where two slide tool units 100A and six rotation tool units 100B are attached to the rotary table 22.

Since an operation to rotate a wire around the wire axis does not need to be performed, the effect of a curving tendency of the wire on the product shape can be minimized.

Also, the relative positions of the tools T1 and T2 with respect to the wire guide 91 can be changed by the rotary table 22, without pivoting the wire guide 91. As a result, similarly to the case of pivoting the wire guide 91, it is possible to change a spring forming space by changing the space on an inclined face 92 side of the wire guide 91, and to form a spring with a desired shape regardless of the tool attachment positions.

Configuration of Wire Feeder

Next, a configuration of the wire feeder will be described with reference to FIGS. 10 to 12.

Figure 10:
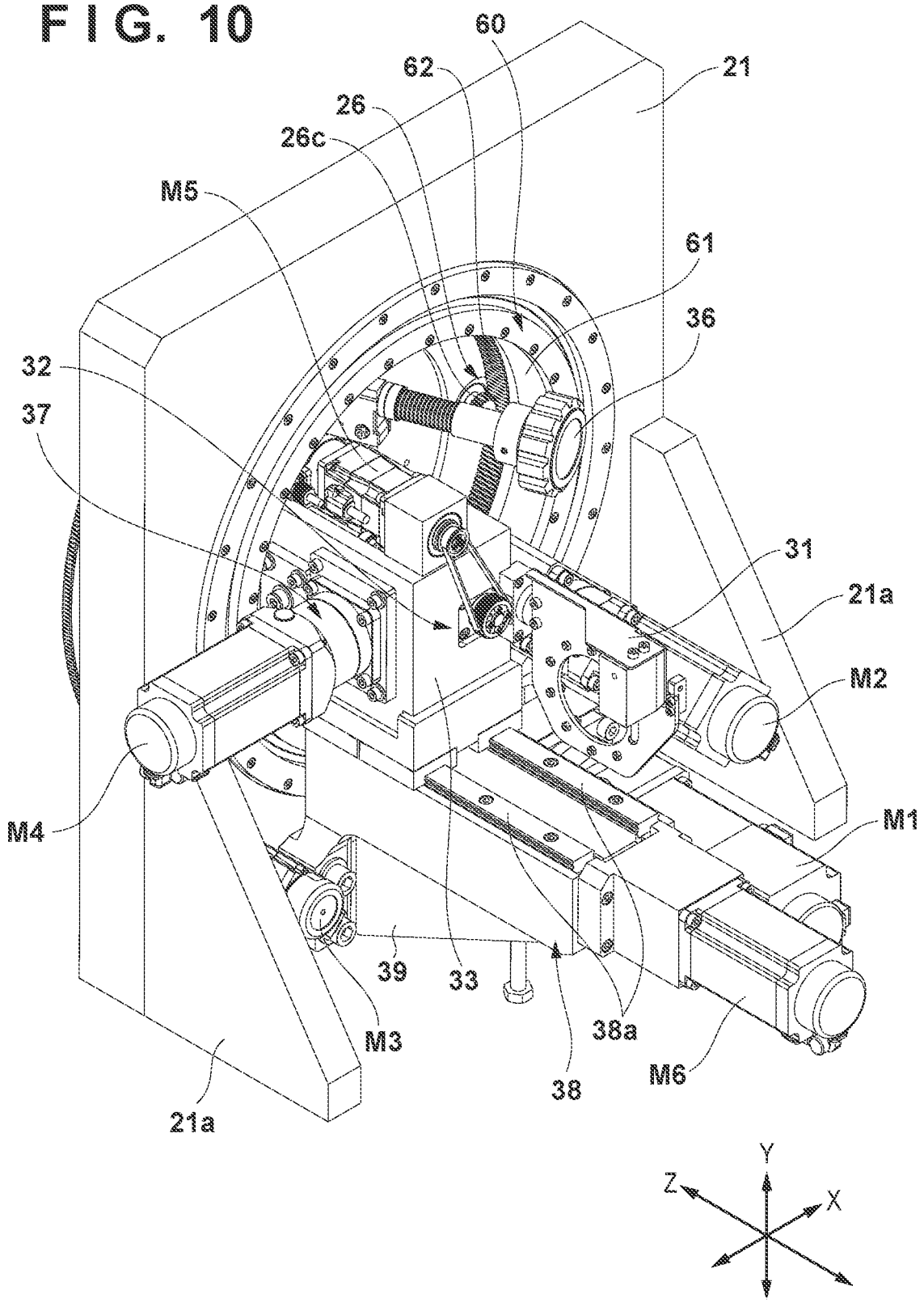
FIG. 10 is a back perspective view of the forming table in FIG. 1.
Figure 11:
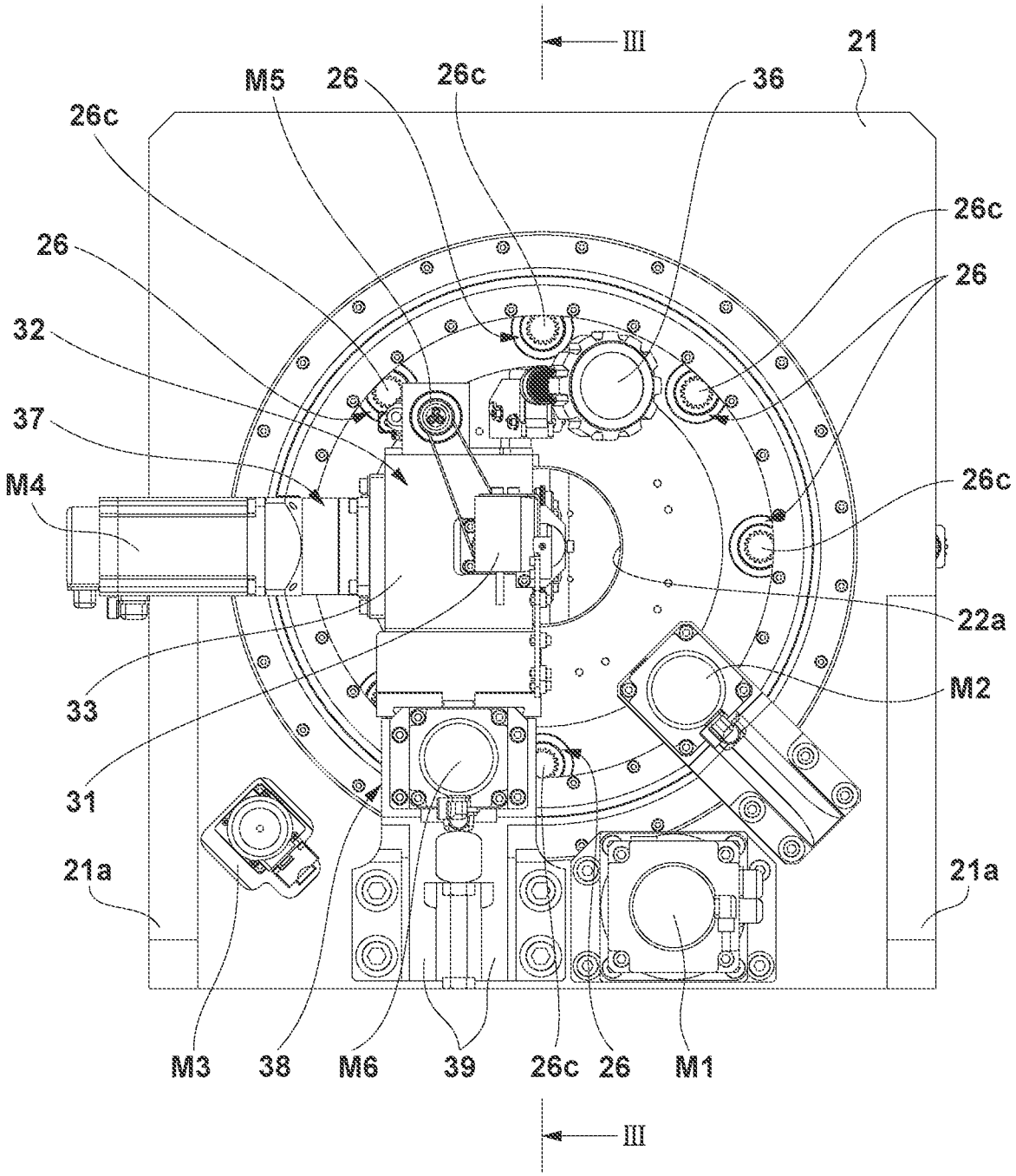
FIG. 11 is a back view of the forming table in FIG. 1.
Figure 12:
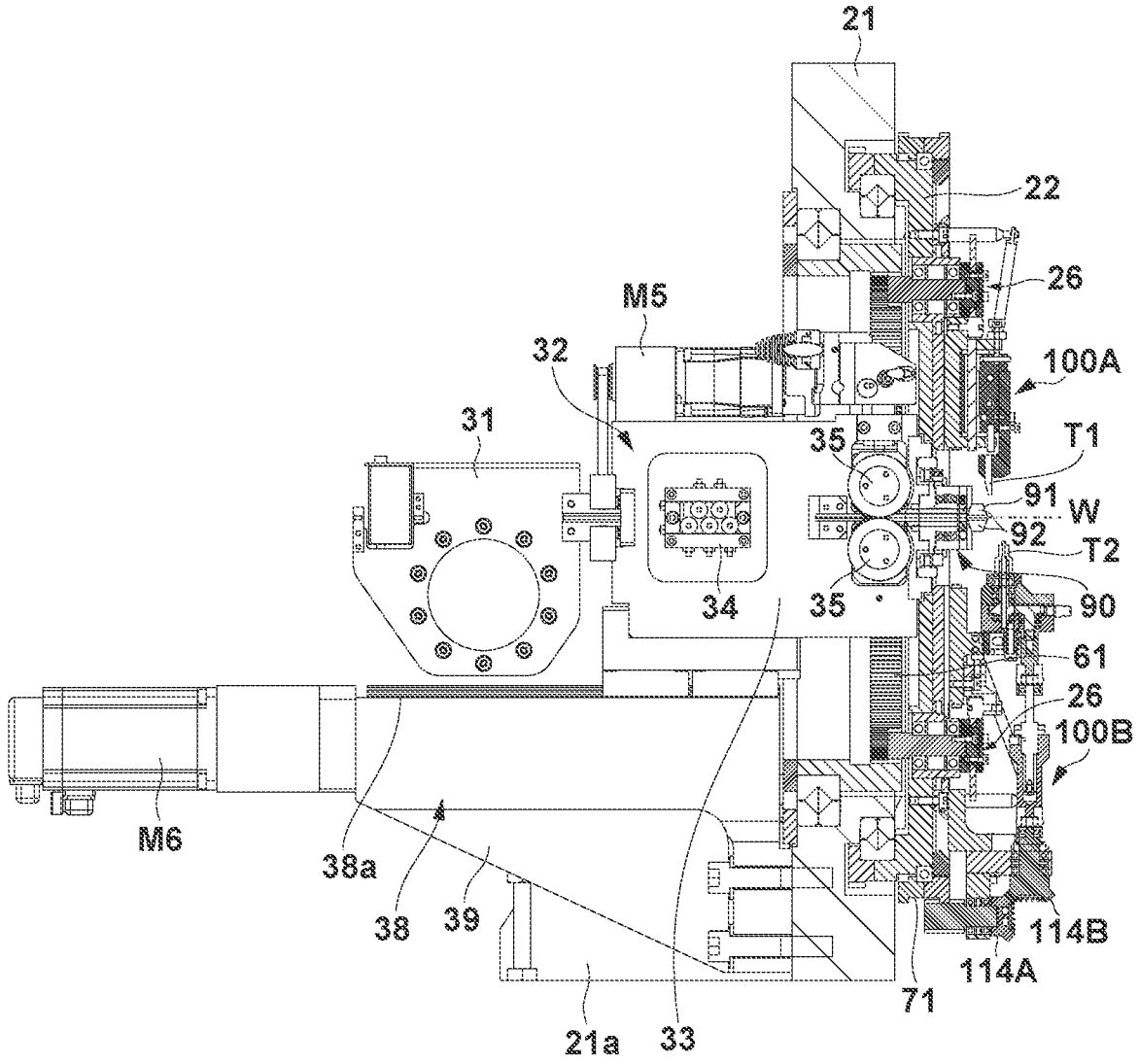
FIG. 12 is a cross-sectional view of FIG. 11 taken along III-III.

As shown in FIGS. 10 to 12, the wire feeder 30 includes a wire supply mechanism 31 that is held with a wire wound therearound, a wire feeding mechanism 32 that pulls the wire from the wire supply mechanism 31 and feeds the wire to the forming table 20, and the wire guide unit 90 that is supported by the wire feeding mechanism 32. The wire supply mechanism 31 is supported by the wire feeding mechanism 32 and is integrated with the wire feeding mechanism 32.

The wire feeding mechanism 32 has a body portion 33 that can be moved on rails 38*a* along a wire feeding direction (Z direction) by a servo motor M6 of a feeder moving mechanism 38, and the wire supply mechanism 31 is attached behind the body portion 33. The feeder moving mechanism 38 is fixed to a back face portion of the forming table 20 by a support member 39.

A mechanism 34 for correcting a curving tendency of a wire and a pair of upper and lower feed rollers 35 are provided within the body portion 33 to which the wire supply mechanism 31 is attached, and the wire guide unit 90 is rotatably supported in the front face portion of the body portion 33.

The wire feeding mechanism 32 pulls the wire from the wire supply mechanism 31 and guides the wire to the wire guide unit 90 by rotating the wire while holding the wire from opposite sides using the pair of upper and lower feed rollers 35. The pressing force with which the feed rollers 35 hold the wire can be adjusted by a handle 36 that is provided at an upper portion of the body portion 33.

A curving tendency correction mechanism 34 is constituted by a plurality of small-diameter rollers arranged above and below in a staggered arrangement, and feeds the wire to the feed rollers 35 after correcting the curving tendency of the wire pulled from the wire supply mechanism 31.

The wire guide unit 90 feeds the wire fed from the feed rollers 35 toward a spring forming space at a leading end portion using the wire guide 91. A driving force of a servo motor M5, which is provided at an upper portion of the body portion 33 of the wire feeding mechanism 32, is transmitted to the wire guide unit 90 via a belt, and the wire guide unit 90 is pivoted. A space surrounded by the inclined face 92 of the wire guide 91 and the tools T1 and T2 functions as the spring forming space. The feed rollers 35 are driven to rotate in a wire feeding direction by a servo motor M4 of a feed roller driving mechanism 37.

In the case of thus pivoting the wire guide 91 as well, similarly to the case of rotating the rotary table 22 without pivoting the wire guide 91, it is possible to change the spring forming space by changing the space on the inclined face 92 side of the wire guide 91 and form a spring with a desired shape regardless of the tool attachment positions.

Since the wire feeding mechanism 32 can be moved back and forth in the wire feeding direction (Z direction) by the feeder moving mechanism 38, the wire feeding mechanism 32 can move between a forming position at which the wire guide 91 is located in the spring forming space and a retraction position at which the wire guide 91 is retracted from the spring forming space. As a result of thus enabling the wire feeder 30 to move in the wire feeding direction, an operation to replace the tools T1 and T2 can be facilitated by sufficiently retracting the wire guide 91 from the spring forming space.

Configuration of Controller

Next, a configuration of the controller of the spring manufacturing apparatus 1 of the present embodiment will be described with reference to FIG. 13.

Figure 13:
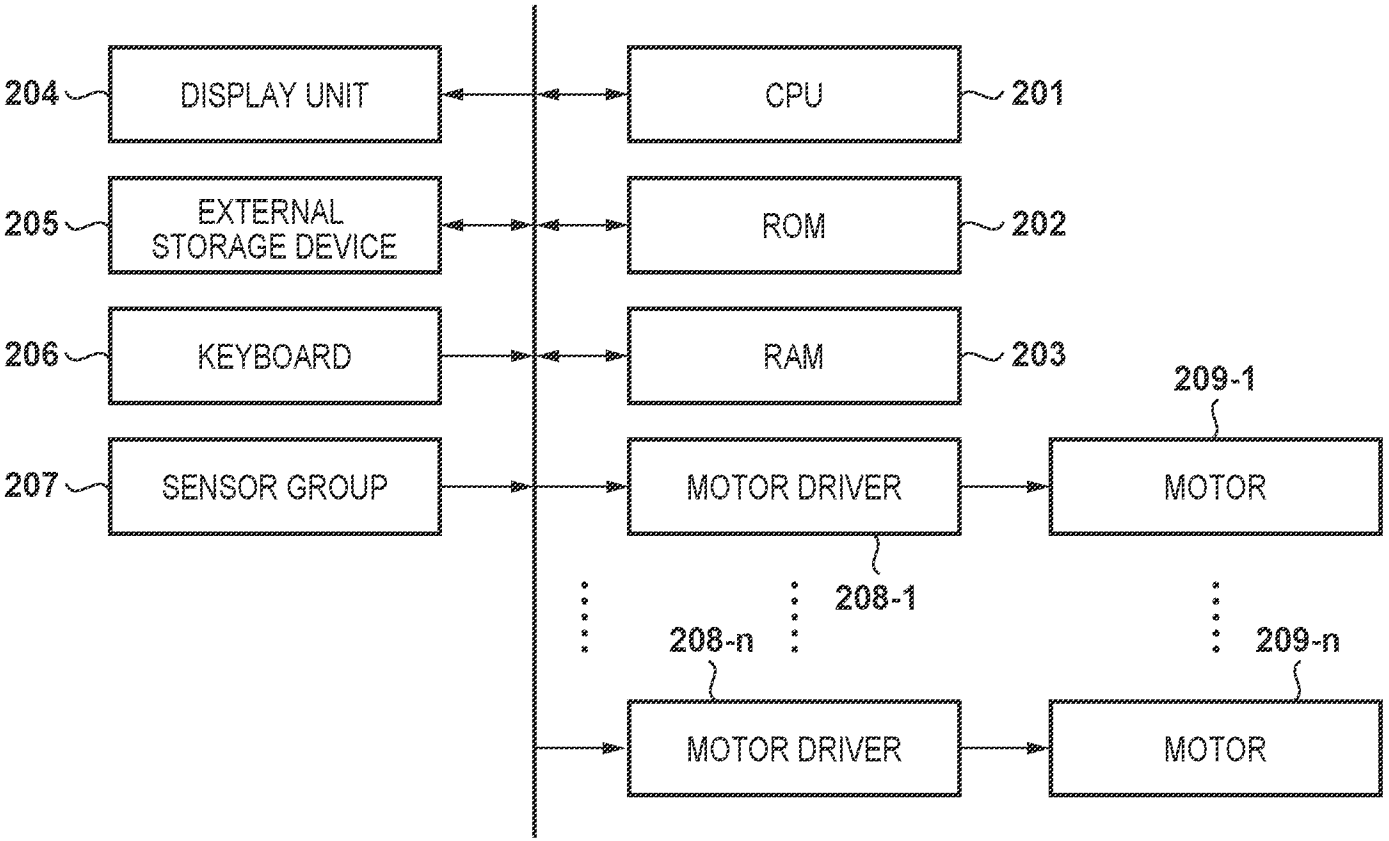
FIG. 13 is a block diagram of a control system of the spring manufacturing apparatus of the present embodiment.

As shown in FIG. 13, a CPU 201 comprehensively controls the entire controller. A ROM 202 stores the content (program) of operational processing of the CPU 201 and various font data. A RAM 203 is used as a work area of the CPU 201. A display unit 204 is provided in order to make various settings and display the content of these settings, as well as to display the process of manufacturing or the like in the form of graphs. An external storage device 205 is a memory card or the like, and is used to supply a program from the outside and save the content of various settings for wire forming processes. As a result, for example, by storing parameters for a certain forming process (e.g., in the case of a spring, free length, coil diameter, etc. thereof), it is possible to manufacture springs of the same shape by setting this memory card and executing the process at any time.

A keyboard 206 is provided in order to set various parameters, and a sensor group 207 is provided in order to detect a wire feeding amount, the free length of a spring, and the like.

Motors 208-1 to **208-*n* correspond to the servo motor M1 of the table driving mechanism 40, the servo motor M2 of the tool slide mechanism 60, the servo motor M3 of the tool rotation mechanism 70, the servo motor M4 of the feed roller driving mechanism 37, the servo motor M5 of the wire guide unit 90, and the servo motor M6 of the feeder moving mechanism 38, respectively, and the motors 208-1 to 208-*n* are driven by respective motor drivers 209-1 to 209-*n***.

Note that, in this example, the CPU 201 drives various motors independently, inputs and outputs data to and from the external storage device 205, and controls the display unit 204, for example, in accordance with instructions input from the keyboard 206.

The invention is not limited to the foregoing embodiments, and various variations/changes are possible within the spirit of the invention. The invention is not limited to the foregoing embodiments, and various variations/changes are possible within the spirit of the invention. For example, the type, number, and arrangement of tools are not limited to the configuration described as an example in the embodiment, and can be changed in any manner in accordance with the wire diameter and the product shape.

What is claimed is:

1. A wire forming apparatus that feeds a wire to a forming space at a leading end of a wire guide and processes the wire into a desired shape using a plurality of tools that are radially arranged, the apparatus comprising:

a rotary table that is rotatably supported by a table body and can rotate to change relative positions of the tools with respect to the wire guide, the tools being able to be attached to and detached from the rotary table;

a table driving mechanism that is supported by the table body and rotates the rotary table;

a slide tool unit that is attached to the rotary table and supports a slide tool capable of sliding toward the wire guide, of the plurality of tools;

a tool slide mechanism that is supported by the table body and transmits a driving force for sliding the slide tool to the slide tool unit;

a rotation tool unit that is attached to the rotary table and supports a rotation tool capable of rotating around a tool shaft, of the plurality of tools; and a tool rotation mechanism that is supported by the rotary table and transmits a driving force for rotating the rotation tool around the tool shaft to the rotation tool unit, wherein the tool slide mechanism has a single first motive power transmission member that is rotatably supported by the table body, and the first motive power transmission member transmits a common driving force for sliding one or more slide tool and rotation tool attached to the rotary table, and wherein the tool rotation mechanism has a single second motive power transmission member that is rotatably supported by the rotary table, and the second motive power transmission member transmits a common driving force for rotating one or more rotation tool attached to the rotary table.

2. The apparatus according to claim 1, wherein the first motive power transmission member transmits a driving force for sliding the rotation tool toward the wire guide to the rotation tool unit, and the driving force generated by a rotation of the first motive power transmission member is transmitted, in common, to a plurality of rotation tools attached to the rotary table.

3. The apparatus according to claim 1, wherein the first motive power transmission member has a ring-like outer shape with a gear formed in an inner-circumferential portion, and the tool slide mechanism includes a motor that rotates the first motive power transmission member via the gear.

4. The apparatus according to claim 1, wherein the second motive power transmission member has a ring-like outer shape with a gear formed in an outer-circumferential portion, and the tool rotation mechanism includes a motor that rotates the second motive power transmission member via the gear.

5. The apparatus according to claim 1, wherein the rotary table is provided with cam mechanisms that transmit, to each of the tool units, the driving force of the first motive power transmission member as a driving force for sliding all of the slide tool and the rotation tool attached to the rotary table.

6. The apparatus according to claim 5, wherein the cam mechanisms are arranged radially with respect to a wire axis of the wire guide at equal intervals in a front face portion of the rotary table, and are provided in correspondence with tool attachment positions on the rotary table, the slide tool unit has a slider to which the slide tool is attached and that slides in contact with an eccentric cam of a corresponding one of the cam mechanisms, and a gear provided on a rotating shaft of the eccentric cam of each of the cam mechanisms meshes with a gear of the first motive power transmission member to rotate the eccentric cam, and the rotating eccentric cam comes into contact with the slider to slide the slide tool.

7. The apparatus according to claim 1, wherein the rotation tool unit includes a base member that rotatably supports a tool shaft to which the rotation tool is attached, and a first gear portion and a second gear portion that are rotatably supported by the base member, and a gear of the second motive power transmission member meshes with a gear formed on a shaft of the first gear portion, and the second gear portion that meshes with the first gear portion rotates the tool shaft to rotate the rotation tools around the tool shaft.

8. The apparatus according to claim 7, wherein the first gear portion and the second gear portion are bevel gears, and turns, by 90 degrees, a direction of a rotating shaft of the second motive power transmission member to transmit the driving force to the tool shaft.

9. The apparatus according to claim 7, wherein the rotary table has a gear formed in an outer-circumferential portion, and has, in a front face portion, a hollow, disc-like outer shape to and from which the tool units of the tools can be attached and detached, the second motive power transmission member is a ring gear in which two rows of gears are formed in an outer-circumferential portion, and one of the two rows of gears meshes with the first gear portion.

10. The apparatus according to claim 1, further comprising:

a wire feeder that supports the wire guide and feeds the wire to the wire guide; and a feeder moving mechanism that moves the wire feeder along a direction in which the wire is fed, wherein the wire feeder is moved between a forming position at which the wire guide is located in the forming space and a retraction position at which the wire guide is retracted from the forming space.

11. The apparatus according to claim 10, wherein the wire feeder includes a wire supply mechanism that supplies the wire, and a wire feeding mechanism that pulls the wire from the wire supply mechanism and feeds the wire to the wire guide, and the feeder moving mechanism moves the wire feeder by a driving force of a servo motor.

12. The apparatus according to claim 10, wherein the wire feeder feeds the wire without pivoting the wire around a wire axis.

* * * * *